US011619015B2

(12) United States Patent
Hughes, Jr.

(10) Patent No.: US 11,619,015 B2
(45) Date of Patent: Apr. 4, 2023

(54) REFLECTIVE TRAFFIC CONTROL MARKER

(71) Applicant: Robert K. Hughes, Jr., Fort Myers, FL (US)

(72) Inventor: Robert K. Hughes, Jr., Fort Myers, FL (US)

( * ) Notice: Subject to any disclaimer, the term of this patent is extended or adjusted under 35 U.S.C. 154(b) by 0 days.

(21) Appl. No.: 15/948,176

(22) Filed: Apr. 9, 2018

(65) Prior Publication Data

US 2018/0291573 A1 Oct. 11, 2018

Related U.S. Application Data

(60) Provisional application No. 62/483,164, filed on Apr. 7, 2017.

(51) Int. Cl.
*E01F 9/619* (2016.01)
*E01F 9/627* (2016.01)
*E01F 9/681* (2016.01)

(52) U.S. Cl.
CPC ..... *E01F 9/629* (2016.02); *E01F 9/619* (2016.02); *E01F 9/681* (2016.02)

(58) Field of Classification Search
CPC ... E01F 9/619; E01F 9/60; E01F 9/602; E01F 9/623; E01F 9/627
USPC ..... 404/9–10; 116/63 R
See application file for complete search history.

(56) References Cited

U.S. PATENT DOCUMENTS 2,297,313 A * 9/1942 Molla ..... E01F 9/61 359/542
2,975,412 A * 3/1961 Fuller ..... G08B 5/38 340/815.73
3,056,495 A * 10/1962 Malachowski ..... B60Q 7/005 206/573
3,913,518 A * 10/1975 Kaplan ..... E01F 9/688 116/63 C
4,092,081 A * 5/1978 Schmanski ..... E01F 9/627 404/10
4,122,795 A * 10/1978 Doring ..... E01F 9/629 116/63 R
4,245,922 A * 1/1981 Auriemma ..... E01F 9/619 404/10

(Continued)

FOREIGN PATENT DOCUMENTS

DE 2137701 A1 * 2/1973 ..... E01F 9/619
FR 2307915 A1 * 11/1976 ..... E01F 9/623

(Continued)

*Primary Examiner* — Thomas B Will
*Assistant Examiner* — Katherine J Chu
(74) *Attorney, Agent, or Firm* — Bracewell LLP; Brad Y. Chin

(57) ABSTRACT

A traffic control marker is provided and described herein. The traffic control marker can be configured with a main marker body that is flexible and durable, the main marker body can be further configured with a reflective element that covers at least a portion of the main marker body. The main marker body can further be configured with an indentation or a channel that extends a portion of or alternatively the length of the main marker body. The reflective element is configured to be protected during a vehicle impact with the traffic control marker, such that at least a portion of the reflective element remains effective and reflective after the impact.

6 Claims, 9 Drawing Sheets

(56) References Cited

U.S. PATENT DOCUMENTS 4,445,803 A * 5/1984 Dixon ..... E01F 9/573 404/10
4,542,709 A * 9/1985 Spaugh ..... B60Q 7/00 116/63 P
4,571,118 A * 2/1986 Schmanski ..... E01F 9/629 116/63 R
4,596,489 A * 6/1986 Mariol ..... E05D 1/02 404/10
5,028,166 A * 7/1991 Leishman ..... E04H 17/263 404/10
5,197,819 A * 3/1993 Hughes ..... E01F 9/681 116/63 R
5,205,236 A * 4/1993 Hughes ..... E01F 9/629 116/209
5,267,523 A * 12/1993 Hugron ..... E01F 9/627 116/63 R
5,460,115 A * 10/1995 Speer ..... E01F 9/535 116/63 P
5,483,917 A * 1/1996 Walker ..... E01F 9/692 116/63 P
5,908,262 A * 6/1999 Ahn ..... E01F 9/675 404/9
6,109,754 A * 8/2000 Steele ..... E01F 9/619 359/520
6,375,385 B1 * 4/2002 Kennedy ..... E01F 9/65 116/63 R
6,764,249 B2 * 7/2004 Stone ..... E01F 9/541 116/63 R
7,052,201 B2 * 5/2006 Zivkovic ..... E01F 9/685 404/10
8,202,020 B2 * 6/2012 Hughes, Jr. ..... E01F 9/681 116/63 R
8,348,545 B1 * 1/2013 Hughes, Jr. ..... E01F 9/681 40/608
8,734,047 B2 * 5/2014 Hughes, Jr. ..... E01F 9/629 404/9
8,888,302 B2 * 11/2014 Philip ..... E01F 9/619 359/515
9,528,231 B2 * 12/2016 Hughes, Jr. ..... E01F 9/60
9,988,777 B2 * 6/2018 Lee ..... E01F 9/629
11,434,613 B2 * 9/2022 Colquhoun ..... E01F 15/0469
2010/0254761 A1 * 10/2010 Wheeler, Jr. ..... E05D 7/0423 404/10

FOREIGN PATENT DOCUMENTS

FR 2856094 A1 * 12/2004 ..... E04C 3/40
GB 958657 A * 5/1964 ..... E01F 9/65
NL 1004730 C1 * 6/1998 ..... E01F 9/608
WO WO-8102435 A * 9/1981 ..... E01F 9/629
WO WO-2016179629 A1 * 11/2016 ..... E01F 9/619

* cited by examiner

REFLECTIVE TRAFFIC CONTROL MARKER

PRIORITY CLAIM

This application is a non-provisional application claiming priority to U.S. Prov. App. No. 62/483,164, filed Apr. 7, 2017, the entire disclosure of which is expressly incorporated by reference.

BACKGROUND

Field

Embodiments generally relate to traffic control markers for highway and/or roadway systems. More specifically, embodiments relate to traffic control markers for highway and/or roadway systems having reflective material.

Description of the Related Art

Many modern highway and roadway systems utilize traffic control markers, also known as guide posts, delineators, and stakes, to provide a variety of indications to motorists. Generally, highway traffic control markers can be used to mark the boundaries of roadways or to indicate special access lanes, such as toll lanes or high-occupancy vehicle lanes, though other uses also exist. Some areas of the highway, such as shoulder areas and zones that buffer cars from hazards routinely use traffic control markers to indicate to motorists that these areas are not safe to drive in. The traffic control markers usually have reflective material to provide a distinct indication to motorists traveling at night. A vehicle's lights reflect off the reflective material on the traffic control marker, thereby indicating to the driver they should not cross the boundary indicated by the marker. Despite these advantages, several problems still exist in the field of reflective traffic control markers. In general, traffic control markers are constructed to survive multiple impacts by vehicles of varying shapes, sizes, and dimensions. After one or many impacts, the reflective material can become marred or blackened, such that the reflective material no longer performs adequately on a particular marker or on a section of markers. Most traffic control markers in operation can be struck a certain number of times before the reflective portion of the marker is substantially marred or blackened, such that a driver can no longer see the marker or a group of markers at night.

It would thus be desirable to have a traffic control marker, delineator, guide post, and/or stake that will remain reflective and effective after one or multiple impacts. Such a marker would provide safer roadways for motorists and also provide a cost benefit by reducing the routine service and replacement expenses for traffic control markers.

SUMMARY

Disclosed herein is a traffic control marker comprising: a flexible tube having a bottom end configured to be secured to the ground and comprising a longitudinal channel, wherein the longitudinal channel is formed by a first channel edge and a second channel edge and is configured to be facing towards oncoming traffic; and a reflective element positioned in an inner portion of the longitudinal channel, wherein the first channel edge and the second channel edge are configured to close inward towards the inner portion during vehicle impact event so to protect at least a portion of the reflective element. In some embodiments, the flexible tube comprises plastic material having a vibrant color. In some embodiments, the reflective element includes an illumination source. In some embodiments, the first channel edge and the second channel edge are rigid ribs protruding out from the flexible tube.

In some embodiments, a portion of the flexible tube between two ends has cross-sectional thickness greater than cross-sectional thickness of the bottom end configured to absorb contact during vehicle impact event. In some embodiments, the traffic control marker further comprises an inner core, wherein the inner core is substantially cylindrical and is positioned coaxially within the flexible tube wherein one end of the inner core is configured to be secured to the ground.

In some embodiments, the traffic control marker further comprises a ground base fixed to the ground wherein the bottom end of the flexible tube is coupled to the ground base. In some embodiments, the traffic control marker further comprises a retention ring and a retention ring receiver, wherein the retention ring receiver is coupled to the flexible tube and includes a retention shoulder, wherein the retention ring is positioned in a recess in the ground base, is coupled to the retention ring receiver, and includes a retention ring shoulder configured to mate with the retention shoulder of the retention ring receiver. In some embodiments, the traffic control marker further comprises a retention pin, wherein each of the ground base, the retention ring, and the retention ring receiver has two pin holes on opposing sides such that the retention pin is inserted through the ground base, the retention ring, and the retention ring receiver configured to secure the flexible tube.

Also disclosed herein is a traffic control marker, comprising: a flexible tube having a bottom end configured to be secured to the ground; at least one protective flap attached to the flexible tube; and a reflective element positioned on an exterior portion of the flexible tube and beneath the at least one protective flap wherein the reflective element is facing towards oncoming traffic, wherein the at least one protective flap is configured to close towards the flexible tube during vehicle impact event so to protect at least a portion of the reflective element. In some embodiments, the flexible tube comprises plastic material having a vibrant color. In some embodiments, the reflective element includes an illumination source.

In some embodiments, the at least one protective flap is longitudinally attached to the flexible tube. In some embodiments, a longitudinal channel is formed by the at least one protective flap and the reflective element is positioned in an inner portion of the longitudinal channel. In other embodiments, the at least one protective flap is transversely attached to the flexible tube.

In some embodiments, a portion of the flexible tube between two ends has cross-sectional thickness greater than cross-sectional thickness of the bottom end configured to absorb contact during vehicle impact event. In some embodiments, the traffic control marker further comprises an inner core, wherein the inner core is substantially cylindrical and is positioned coaxially within the flexible tube wherein one end of the inner core is configured to be secured to the ground.

In some embodiments, the traffic control marker further comprises a ground base fixed to the ground wherein the bottom end of the flexible tube is coupled to the ground base. In some embodiments, the traffic control marker further comprises a retention ring and a retention ring receiver, wherein the retention ring receiver is coupled to the flexible tube and includes a retention shoulder, wherein the retention ring is positioned in a recess in the ground base, is coupled to the retention ring receiver, and includes a retention ring shoulder configured to mate with the retention shoulder of the retention ring receiver. In some embodiments, the traffic control marker further comprises a retention pin, wherein each of the ground base, the retention ring, and the retention ring receiver has two pin holes on opposing sides such that the retention pin is inserted through the ground base, the retention ring, and the retention ring receiver configured to secure the flexible tube.

BRIEF DESCRIPTION OF DRAWINGS

The figures and descriptions as provided herein are intended to be illustrative and do not represent, show, or describe every embodiment and/or feature combination that is possible, as such the figures and descriptions should not be deemed limiting and other useful and effective embodiments may be achieved by considering the included descriptions and the included illustrations.

DETAILED DESCRIPTION

Figure 1A:
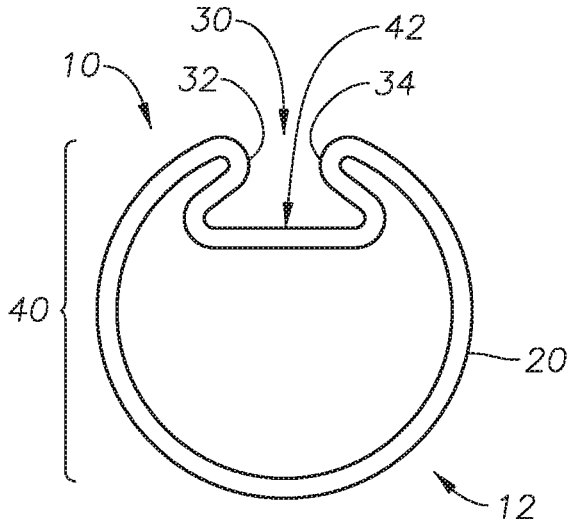
FIG. 1A is a top cross-sectional view of an embodiment of a traffic control marker configured with a reflective element protection channel.

The embodiments and feature combinations as described below should not be deemed limiting, other useful and effective embodiments and feature combinations may be achieved by consideration of the included descriptions and illustrations. The subject matter of this disclosure is not restricted except only in the spirit of the specification and appended claims.

Those of skill in the art also understand that the terminology used for describing particular embodiments does not limit the scope or breadth of the embodiments of the disclosure. In interpreting the specification and appended claims, all terms should be interpreted in the broadest possible manner consistent with the context of each term. All technical and scientific terms used in the specification and appended claims have the same meaning as commonly understood by one of ordinary skill in the art to which this disclosure belongs unless defined otherwise.

Although the disclosure has been described with respect to certain features, it should be understood that the features and embodiments of the features can be combined with other features and embodiments of those features.

Although the disclosure has been described in detail, it should be understood that various changes, substitutions, and alternations can be made without departing from the principle and scope of the disclosure. Accordingly, the scope of the present disclosure should be determined by the following claims and their appropriate legal equivalents.

As used in the specification and appended claims, the singular forms "a", "an", and "the" include plural references unless the context clearly indicates otherwise.

As used, the words "comprise," "has," "includes", and all other grammatical variations are each intended to have an open, non-limiting meaning that does not exclude additional elements, components or steps. Embodiments of the present disclosure may suitably "comprise", "consist" or "consist essentially of" the limiting features disclosed, and may be practiced in the absence of a limiting feature not disclosed. For example, it can be recognized by those skilled in the art that certain steps can be combined into a single step.

Optional or optionally means that the subsequently described event or circumstances can or may not occur. The description includes instances where the event or circumstance occurs and instances where it does not occur.

Where a range of values is provided in the specification or in the appended claims, it is understood that the interval encompasses each intervening value between the upper limit and the lower limit as well as the upper limit and the lower limit. The disclosure encompasses and bounds smaller ranges of the interval subject to any specific exclusion provided.

Where reference is made in the specification and appended claims to a method comprising two or more defined steps, the defined steps can be carried out in any order or simultaneously except where the context excludes that possibility.

As used throughout the disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope of the present disclosure.

Spatial terms describe the relative position of an object or a group of objects relative to another object or group of objects. The spatial relationships apply along vertical and horizontal axes. Orientation and relational words, including "above," "below," "upper," "lower," and other like terms, are for descriptive convenience and are not limiting unless otherwise indicated.

The technology described herein and below and illustrated by accompanying figures, generally relates to improved traffic control markers for highway and/or roadway systems. It should be appreciated that traffic control markers may also be referred to as guide posts, delineators, and stakes, and are used to provide a variety of indications to motorists. Typically traffic control markers, guide posts, and delineators are describing traffic control markers that connect to the ground, and typically stakes are describing markers that insert into the ground, though these terms may also be used interchangeably.

In an embodiment, a traffic control marker, which may also be referred to as a guide post, delineator, or stake, is provided. The traffic control marker can be configured to have reflective sheeting which may surround a portion of the marker. In an embodiment, an indentation and/or channel can be molded into the marker. The indentation or channel may extend down the partial length of a post or may extend the full length of the post on the markers outer surface. The reflective sheeting or other reflective material can be configured to extend and run across the surface of the marker inside the indentation or channel such that at least a portion of the reflective material is protected from impact.

The indention or channel of the above-described embodiment can act like a clamp when the marker is contacted by a vehicle and the reflective material is then shielded by the edge portions of the indentation or channel such that it does not become marred or blackened over time. The channel can further close in on itself and protect the reflective element when the marker is subject to a strong impact.

In an embodiment, a vibrant color of plastic material may be selected for the main body of the marker to allow for higher visibility of the marker. The preferred material for a traffic control markers is often a plastic or other similarly durable material and the reflective material portion of a marker can be a reflective tape, a bicycle reflector, though other reflective materials can be utilized. In an alternate embodiment, the reflective element can be replaced by an alternate reflective material, a light emitting diode, series of light emitting diodes, or other illumination source that will alert a vehicle to the presence of the marker.

In an embodiment, the lower end of a traffic control marker can be configured to be embedded in the roadway. In an embodiment, surface mounts, configured to position the traffic control marker to the ground, may be glued to the asphalt or concrete surface of the roadway. The reflective material and protected portion of reflective materials can be configured to face towards oncoming traffic. When a vehicle strikes the marker, the indentation or channel edges come together due to the force of the impact.

The size of a marker can vary depending on the application and desired visibility profile for a given section of highway or roadway. A marker can also be of various heights. The reflective material can also cover various portions of a marker depending on the desired reflection profile and depending on the configuration of a given section of highway or roadway.

In accordance with another embodiment, a traffic control marker can be configured with a plastic flap that protrudes from the marker and collapses when the marker is impacted. This embodiment can have plastic flaps at various heights and locations along the traffic marker or the flap can extend down the entire length or a substantial portion of the marker.

In accordance with another embodiment, a traffic marker can be configured with two plastic flaps that are attached to the marker. In an impact, these plastic flaps can be arranged such that they fold over each other to protect the reflective material beneath the flaps. These flaps can extend down a portion of the marker, the full length of the marker, or a substantial length of the marker.

In accordance with another embodiment, a traffic control marker can be configured with a set of rigid ribs that protrude out from the main body of the marker and protect the reflective material between and adjacent the ribs. The ribs can extend down a portion of the marker, the full length of the marker, or a substantial length of the marker.

In accordance with another embodiment, a plastic molded post of a traffic control marker can be made with two molding cores being used to create the main body and that go in and after the molding of the post, such that the center of the post is thicker than the ends of the post. The center section being thicker creates a configuration where the inner core is less likely to protrude through the plastic top in an impact situation.

Figure 1B:
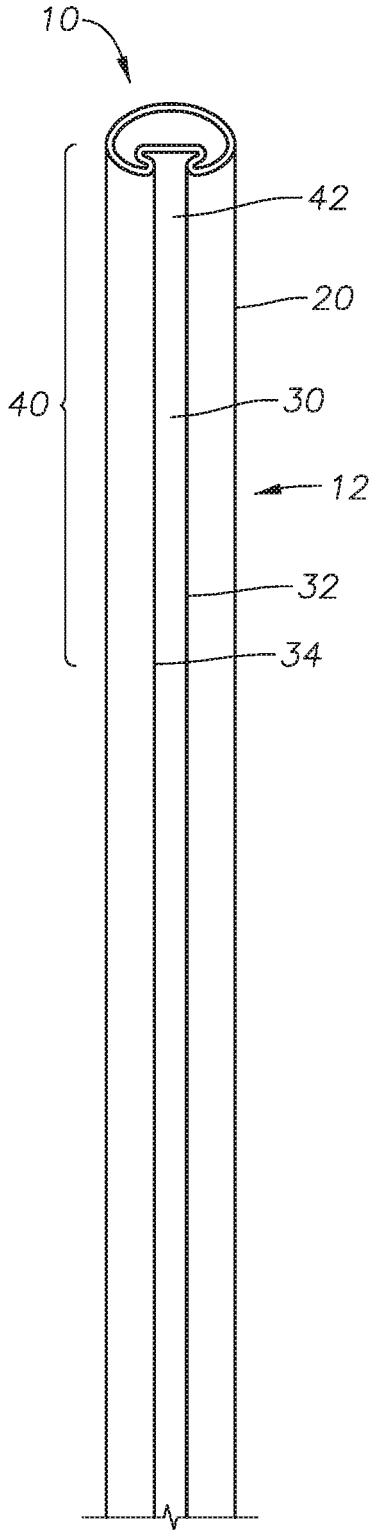
FIG. 1B is a side perspective view of the traffic control marker illustrated in FIG. 1A.

Referring to FIGS. 1A and 1B, a traffic control marker 10 having a main marker body 20 and an indentation or channel 30 extending the length of the main marker body 20 is shown. The bottom end (not shown) of the main marker body 20 is secured to the ground. The main marker body 20 may include a flexible tube. A portion of the main marker body 20 may be covered in a reflective sheet material 40 on the outer upper portion 12 of the main marker body 20. In some embodiments, the main marker body 20 may be entirely covered in the reflective sheet material. The channel 30 of the main marker body 20 includes a first channel edge 32 and a second channel edge 34 that help protect an inner channel reflective sheet material section 42 from being marred or blackened by impacts from vehicles that may run into the traffic control marker 10. The channel 30 of the main marker body 20 is facing towards oncoming traffic such that the inner channel reflective sheet material section 42 is visible to drivers of oncoming traffic.

Figure 2A:
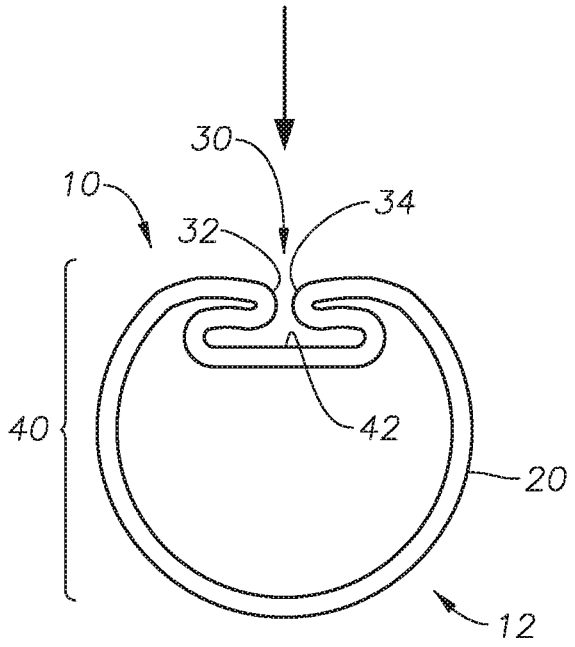
FIG. 2A is a top cross-sectional view of an embodiment of a traffic control marker configured with a reflective element protection channel, such as that shown in FIG. 1A, wherein the marker is shown as it may be positioned during an impact.
Figure 2B:
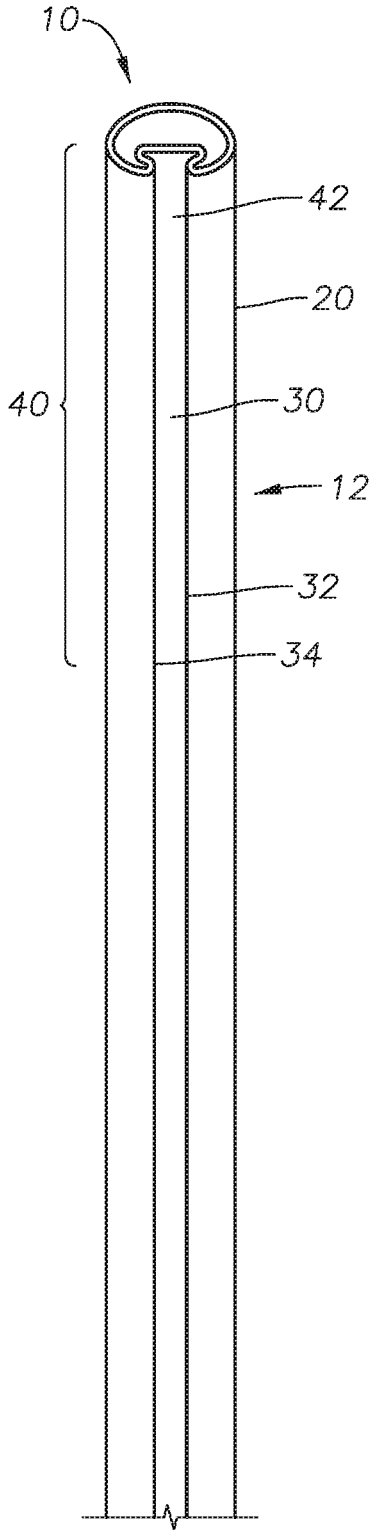
FIG. 2B is a side perspective view of the traffic control marker illustrated in FIG. 2A.

FIGS. 2A and 2B further illustrate the embodiments shown and described in reference to FIGS. 1A and 1B. In FIGS. 2A and 2B, the traffic control marker 10 is shown as it may be positioned during a vehicle impact. The force of the vehicle hitting the traffic control marker 10 (in a direction shown by the solid arrow in FIG. 2A) causes the first channel edge 32 and the second channel edge 34 to close inward towards the inner channel portion of the inner channel reflective sheet material section 42. This feature allows such a traffic control marker 10 to be struck many more times than previous traffic control marker designs allowed for, with the marker remaining reflective and effective. In some embodiments, the traffic control marker 10 is configured to protect the inner channel reflective sheet material section 42 after being struck more than about 100 times by vehicles having speeds of about or exceeding 70 miles per hour. After being struck by a vehicle, in some embodiments, the first channel edge 32 and the second channel edge 34 may return substantially to its initial position shown in FIGS. 1A and 1B such that at least a portion of the inner channel reflective sheet material section 42 is exposed to the motorist. In other embodiments, the first channel edge 32 and the second channel edge 34 may stay in a deformed position similar to the embodiments shown in FIGS. 2A and 2B, however a gap exists between the first channel edge 32 and the second channel edge 34 such that at least a portion of the inner channel reflective sheet material section 42 is still exposed to the motorist. Although reflective sheet material 40 on the outer upper portion 12 of the main marker body 20 may be marred, blackened, or knocked-off, there is some degree of reflectivity maintained due to portions of the inner channel reflective sheet material section 42 being intact and exposed to the motorist. Such a marker 10 provides safer roadways for motorists and also provides a cost benefit by reducing the routine service and replacement expenses for traffic control markers 10. Markers 10 can literally be deployed in the hundreds or thousands along highway and roadway sections and thus the added safety benefits and service cost reductions can be substantial.

In an alternate embodiment of the markers described herein, other types of reflective material can be substituted for the reflective sheet material 40 described in the above and below embodiments. Alternatively, in an embodiment, only a portion of the traffic control marker 10 or a substantial portion, or all of a given marker may be covered in reflective or illuminative material. Further, a traffic control marker body 20 can be of materials with varying thicknesses depending on the desirable characteristics of a marker. Often though, the main body 20 of a traffic control marker 10 will be made from plastic due to its low cost and impact durability. Also, a traffic control marker 10 will often be made in a vibrant color to aide in the visibility of the marker, at least during the day.

Figure 3A:
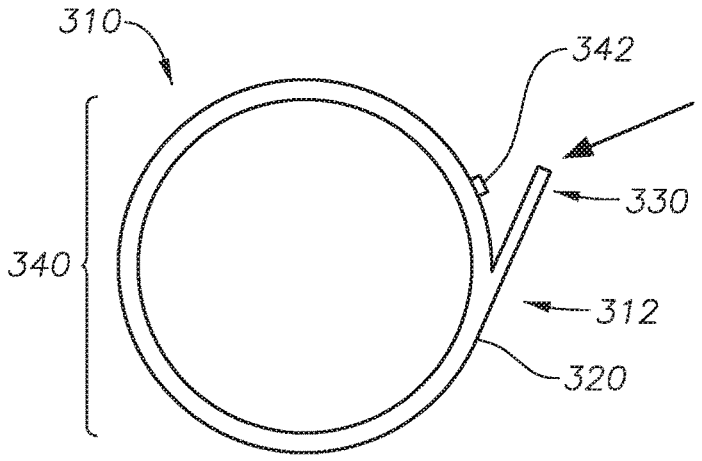
FIG. 3A is a top cross-sectional view of an embodiment of a traffic control marker configured with a protective flap that extends down a main body of the marker.
Figure 3B:
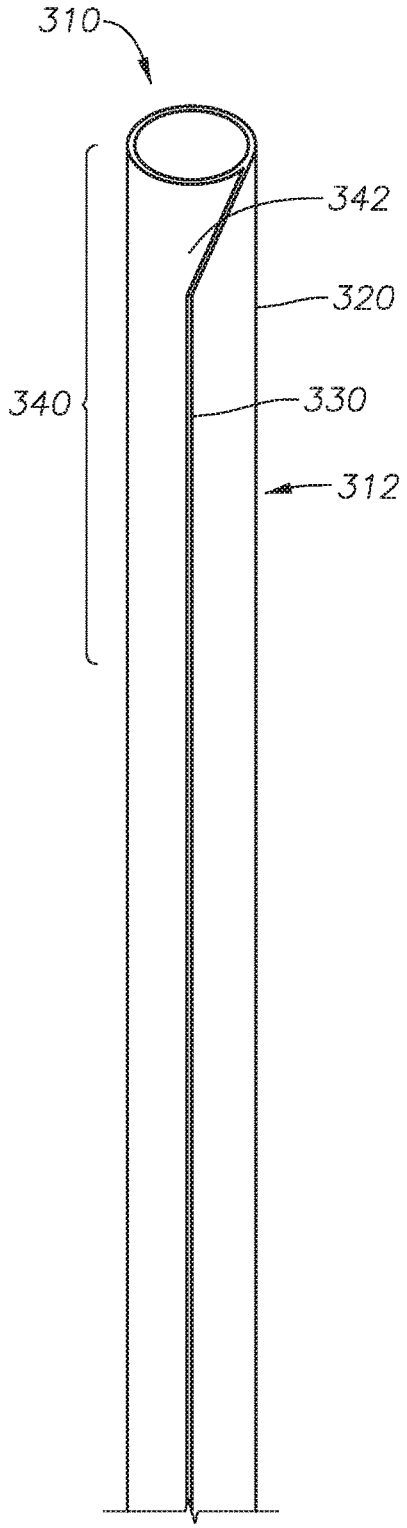
FIG. 3B is a side perspective view of the traffic control marker illustrated in FIG. 3A.

Referring to FIGS. 3A and 3B, a traffic control marker 310 having a main marker body 320 and a protective flap 330 that extends down the length of the main marker body 320 is shown. The bottom end (not shown) of the main marker body 320 is secured to the ground. The main marker body 320 may include a flexible tube. A portion of the main marker body 320 may be covered in a reflective sheet material 340 on the outer upper portion 312 of the main marker body 320. The protective flap 330 helps protect an inner reflective sheet material section 342 positioned just beneath the protective flap 330 from being marred or blackened by impacts from vehicles that may run into the traffic control marker 310. The inner reflective sheet material section 342 of the main marker body 320 is facing towards oncoming traffic such that the inner reflective sheet material section 342 is visible to drivers of oncoming traffic. In an impact (in a direction shown by the solid arrow in FIG. 3A), the protective flap 330 will be caused to move towards the main marker body 320 by the impact, thereby protecting the inner reflective sheet material section 342 from marring or blackening from the impact.

Figure 4A:
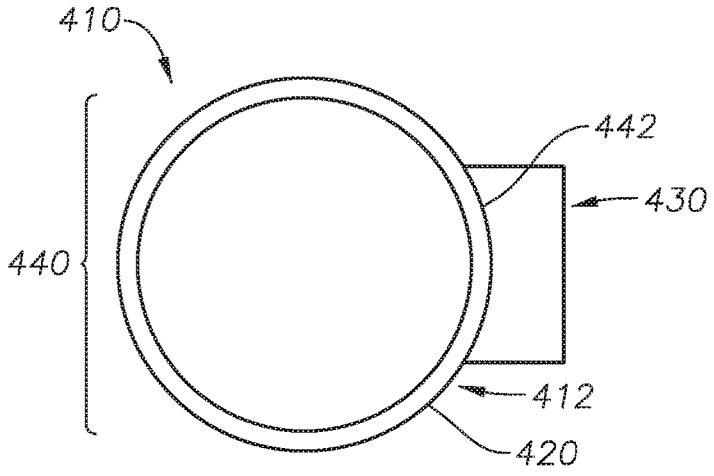
FIG. 4A is a top cross-sectional view of an embodiment of a traffic control marker configured with a series of protective flaps that are configured at various heights along a main body of the marker.
Figure 4B:
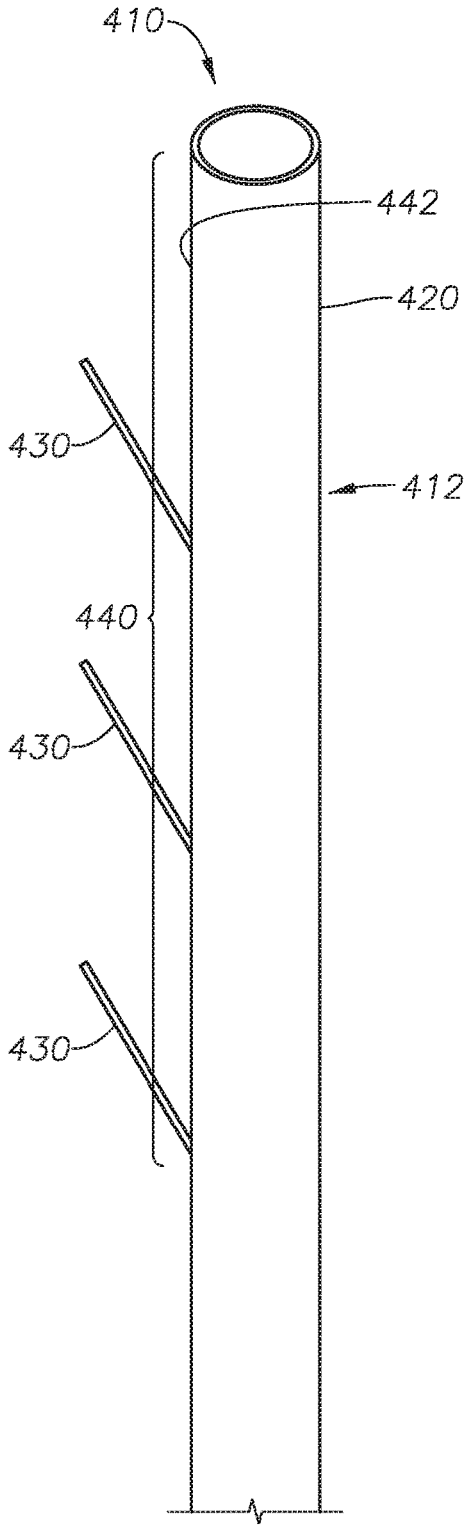
FIG. 4B is a side perspective view of the traffic control marker illustrated in FIG. 4A.

Referring to FIGS. 4A and 4B, a traffic control marker 410 having a main marker body 420 and a series of protective flaps 430 that are configured at various heights along the main marker body 420 is shown. The bottom end (not shown) of the main marker body 420 is secured to the ground. The main marker body 420 may include a flexible tube. A portion of the main marker body 420 may be covered in a reflective sheet material 440 on the outer portion 412 of the main marker body 420. The protective flap 430 helps protect a series of inner reflective sheet material sections 442 positioned just beneath each of the series of protective flaps 430 from being marred or blackened by impacts from vehicles that may run into the traffic control marker 410. The inner reflective sheet material sections 442 of the main marker body 420 are facing towards oncoming traffic such that the inner reflective sheet material sections 442 are visible to drivers of oncoming traffic. In an impact, the series of protective flaps 430 will be caused to move towards the main marker body 420 by the impact, thereby protecting each of the series of inner reflective sheet material sections 442 from marring or blackening from the impact.

Figure 5A:
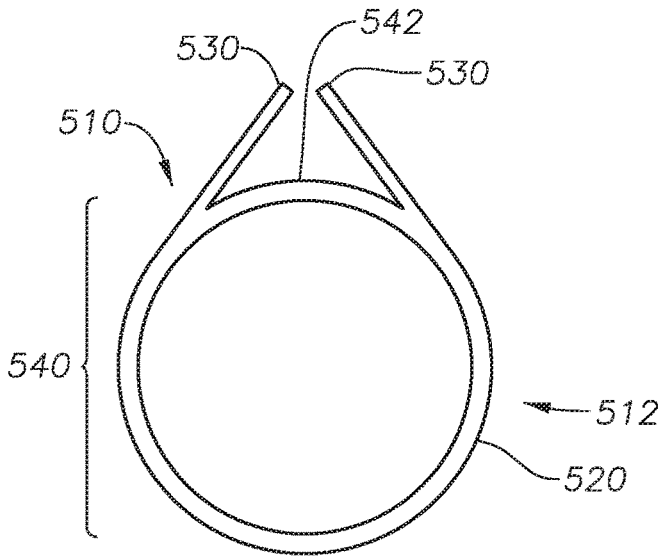
FIG. 5A is a top cross-sectional view of an embodiment of a traffic control marker configured with opposing protective flaps that are configured along a main body of the marker.
Figure 5B:
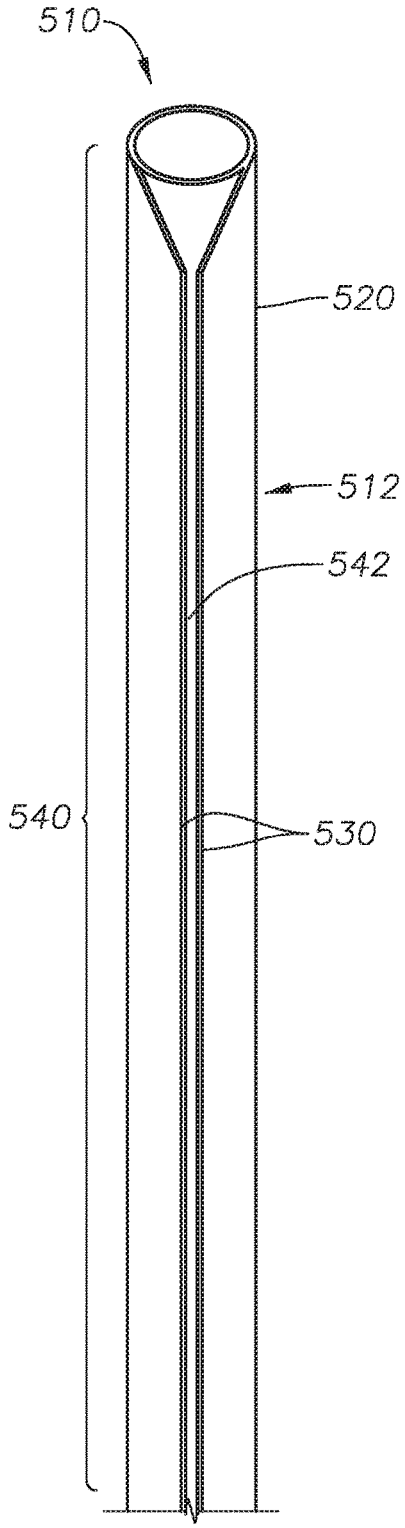
FIG. 5B is a side perspective view of the traffic control marker illustrated in FIG. 5A.

Referring to FIGS. 5A and 5B, a traffic control marker 510 having a main marker body 520 and a pair of opposing protective flaps 530 that are configured to run along the main marker body 520 is shown. The bottom end (not shown) of the main marker body 520 is secured to the ground. The main marker body 520 may include a flexible tube. A portion of the main marker body 520 may be covered in a reflective sheet material 540 on the outer portion 512 of the main marker body 520. The opposing protective flap 530 helps protect an inner reflective sheet material section 542 positioned just beneath each of the protective flaps 530 from being marred or blackened by impacts from vehicles that may run into the traffic control marker 510. The inner reflective sheet material section 542 of the main marker body 520 is facing towards oncoming traffic such that the inner reflective sheet material section 542 is visible to drivers of oncoming traffic. In an impact, the protective flaps 530 will be caused to move towards the main marker body 520 by the impact, thereby protecting the inner reflective sheet material section 542 from marring or blackening from the impact.

Figure 6A:
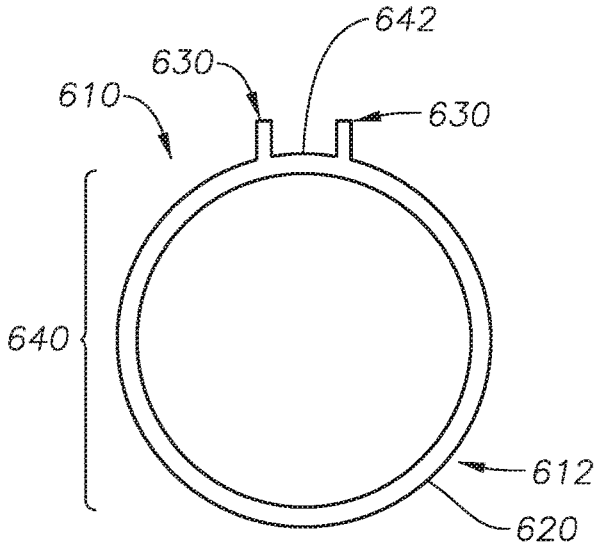
FIG. 6A is a top cross-sectional view of an embodiment of a traffic control marker configured with rigid ribs that are configured to extend along a main body of the marker.
Figure 6B:
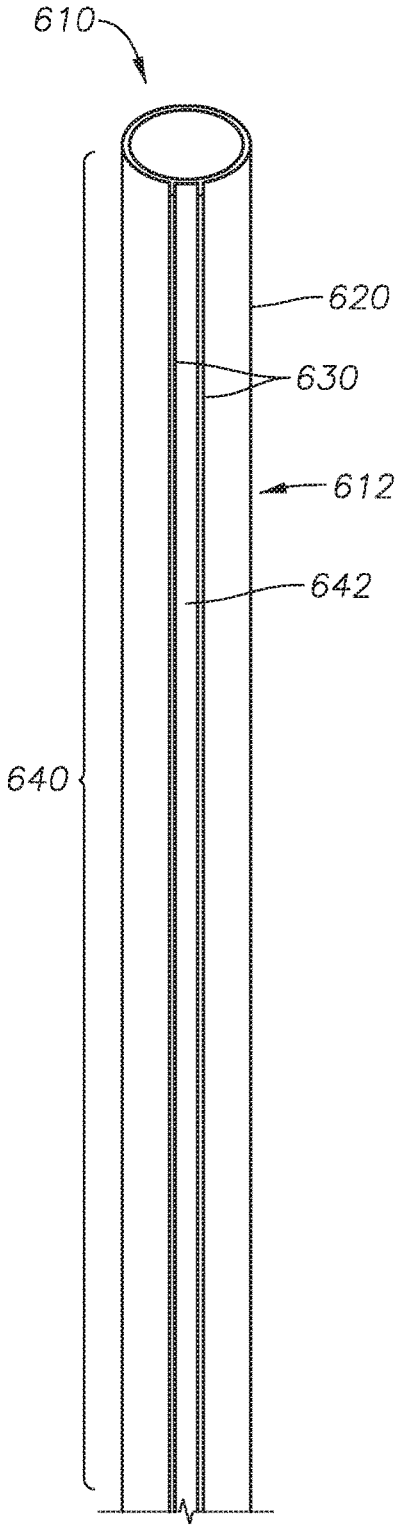
FIG. 6B is a side perspective view of the traffic control marker illustrated in FIG. 6A.

Referring to FIGS. 6A and 6B, a traffic control marker 610 having a main marker body 620 and a pair of rigid ribs 630 that are configured to run along the main marker body 620 is shown. The bottom end (not shown) of the main marker body 620 is secured to the ground. The main marker body 620 may include a flexible tube. In an alternative embodiment the ribs may be flexible rather than rigid (not shown). Referring again to FIGS. 6A and 6B, a portion of the main marker body 620 may be covered in a reflective sheet material 640 on the outer portion 612 of the main marker body 620. The ribs 630 helps protect an inner reflective sheet material section 642 positioned just between each of the ribs 630 from being marred or blackened by impacts from vehicles that may run into the traffic control marker 610. The inner reflective sheet material section 642 of the main marker body 620 is facing towards oncoming traffic such that the inner reflective sheet material section 642 is visible to drivers of oncoming traffic. In an impact, the ribs 630 will be centrally impacted, providing a displacement between the impact and the inner reflective sheet material section 642, thereby protecting the inner reflective sheet material section 642 from marring or blackening from the impact.

In each of the embodiments and configurations described herein, as long as at least a portion 42,342,442,542,642 of reflective material 40,340,440,540,640 is protected from impact, that portion 42,342,442,542,642 of reflective material 40,340,440,540,640 is unlikely to be marred or blackened by the impact and the marker 10,310,410,510,610 will remain reflective and effective for a longer duration of time than would be possible with earlier known reflector designs.

In an alternate embodiment, the reflective element 40,340,440,540,640 can be replaced by an alternate reflective material, a light emitting diode, a series of light emitting diodes, or other illumination source that will alert a vehicle to the presence of the marker 10,310,410,510,610. In a light emitting embodiment, the base or other portion of the traffic control marker 10,310,410,510,610 can be configured with solar panels and a battery can be housed inside the marker 10,310,410,510,610, such that the markers 10,310,410,510,610 can generate enough electricity during the day to keep them illuminated at night. In an alternate embodiment, the solar panels and/or batteries can be displaced from the markers 10,310,410,510,610. Additionally, in each of the above described embodiments, an illumination source can be placed in the protected inner section of the marker 10,310,410,510,610, such that the lights can be protected from vehicle impacts and can continue to function after an impact or number of impacts. In an embodiment, the lower end of a traffic control marker 10,310,410,510,610 can be configured to be embedded in the roadway and the reflective material 40,340,440,540,640 and protected portion 42,342,442,542,642 of reflective materials 40,340,440,540,640 can be configured to face towards oncoming traffic. In an embodiment, the illuminative or light configured section of a marker 10,310,410,510,610 and protected portion 42,342,442,542,642 of the illuminative or light configured section of a marker 10,310,410,510,610 can be configured to face towards oncoming traffic.

Figure 7:
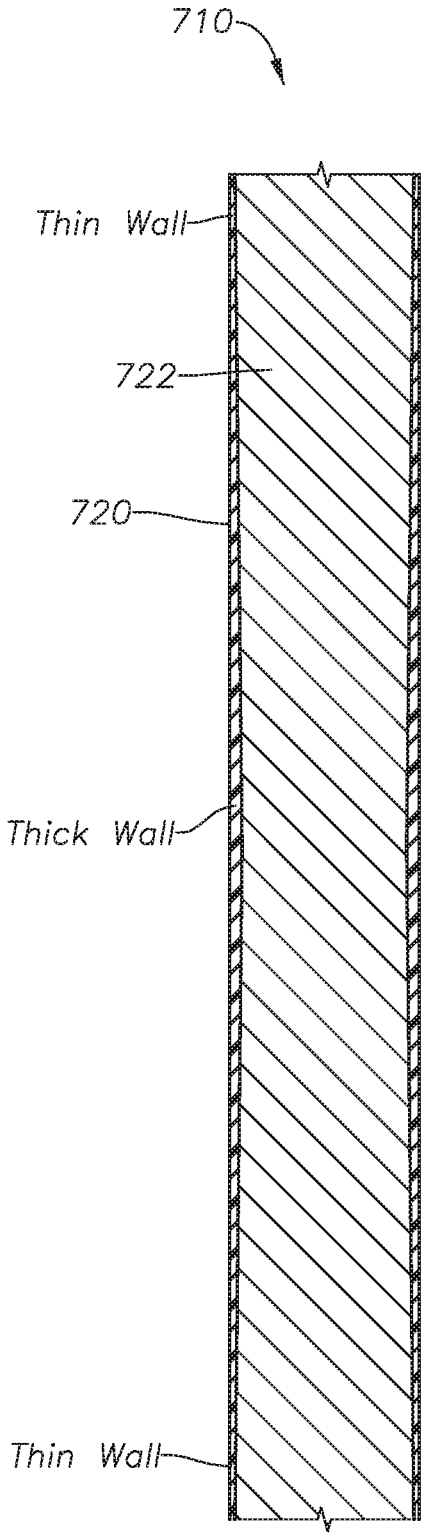
FIG. 7 is a side cross-sectional view of an embodiment of a traffic control marker with thicker walls toward the middle of the marker.

Referring to FIG. 7, an embodiment of a traffic control marker 710 with a thicker middle wall and a thinner bottom wall section is shown. The material that makes up the main marker body 720 can be molded and configured to be thicker toward the middle of the marker 710 to better absorb contact from a vehicle. Accordingly, a mold core 722 is configured to have a thinner middle portion and thicker ends. Each of the various embodiments described can be configured with the mold core 722 design shown. In an embodiment, one or more mold cores 722 may extend from the middle of the post down to both ends.

Figure 8:
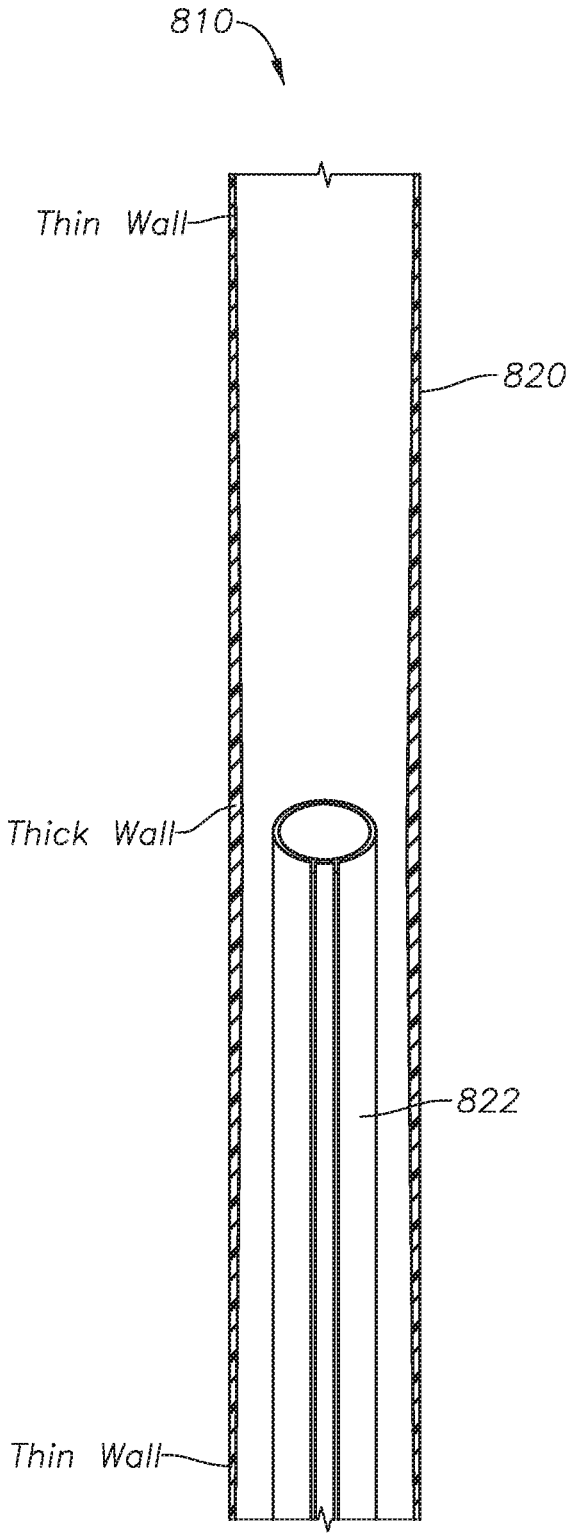
FIG. 8 is a side cross-sectional view of an embodiment of a traffic control marker configured with an inner core.

Referring to FIG. 8, another possible embodiment of a marker main body 820 configured with a thicker middle wall and thinner end walls is shown. In an embodiment, there is an inner core 822 on one end of the marker 810 for added stability. In some embodiments, the inner core 822 is made of a rigid material, a material less flexible than the marker main body 820 for added stability. For this configuration, the material can be molded to be thicker toward the middle of the traffic control marker 810. As shown, the inner core 822 is substantially cylindrical and extends approximately half-way up the traffic marker 810. In some embodiments, the inner core 822 can take on different shapes and extend a portion, substantially or the entirety of the distance of the marker main body 820. In other embodiments, the marker main body 820 does not have a thicker middle wall and thinner end walls, but still has the inner core 822 placed within for added stability.

The traffic control marker 10,310,410,510,610,710,810 embodiments described herein or any other traffic control marker system may include a surface mount base attachment to asphalt and concrete along with a "ground mount" that may secure the traffic control marker 10,310,410,510,610,710,810 to the base.

Figure 9A:
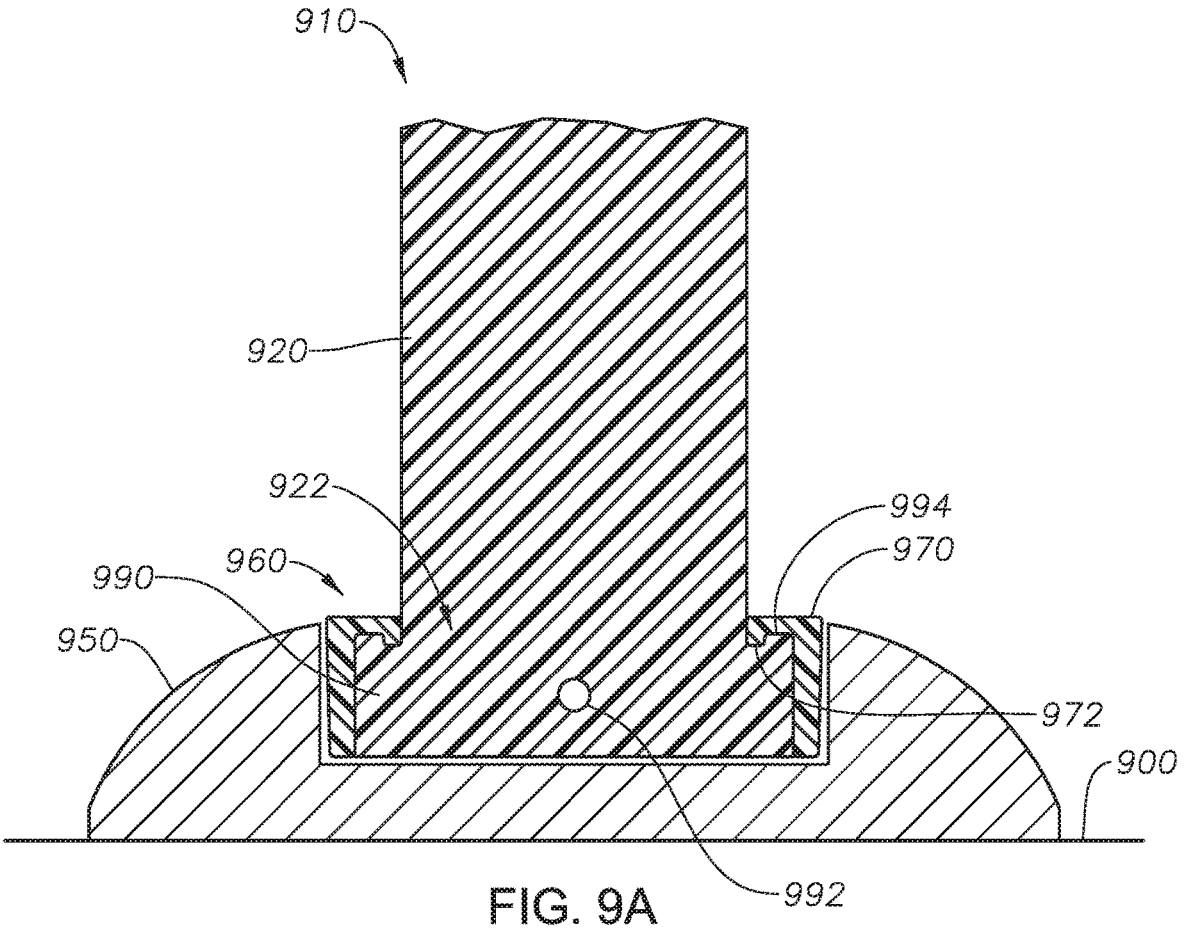
FIG. 9A shows an enlarged side cross-sectional view of the lower portion an embodiment of a traffic control marker configured with a base and retention ring system.
Figure 9B:
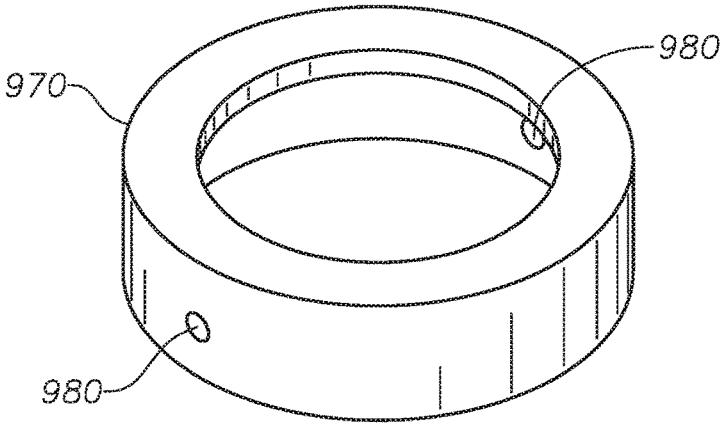
FIG. 9B shows an enlarged perspective view of an embodiment of an upper retention ring.

Referring to FIGS. 9A and 9B, FIG. 9A shows an enlarged side cross-sectional view of the lower portion an embodiment of a traffic control marker 910 configured with a ground base 950 and retention ring system 960. The ground base 950 can be constructed of plastic, rubber, metal, or other materials and a variety of material combinations as well. The ground base 950 can attach to asphalt, concrete, or other hard surfaces, and serves as a mounting point by which a traffic control marker 910 may be secured to the ground 900. In an embodiment, the retention ring system 960 can be configured to include an upper retention ring 970 configured with an upper retention ring shoulder 972 and a retention pin hole 980. In an embodiment, the lower portion 922 of the traffic control marker 910 can be configured to include a retention ring receiver 990 of the traffic control marker main body 920 can be configured to include body retention pin holes 992 and retention shoulder 994 or in an alternative embodiment, the lower portion 922 of the traffic control marker 910 can be a separate piece that connects to the traffic control marker main body 920 (such as in the embodiment illustrated in relation to FIG. 10). When the traffic control marker 910 is installed, the main marker body 920 and lower portion 990 can be inserted into the ground base 950 and the retention ring 970 can be lowered into place inside the cavity of the ground base 950 such that the retention ring shoulder 972 mates with retention shoulder 994, thereby providing added support and stability for the traffic control marker 910. At this point, the retention ring pin hole 980 can be lined up with the body retention pin holes 992 and the base retention pin holes (not shown) and a retention pin (not shown) can be inserted, thereby securing the traffic control marker 910 to the ground base 950 and the ground 900. FIG. 9B shows an enlarged perspective view of an embodiment of an upper retention ring 970 and illustrates retention pin holes 980 on opposing sides of the ring 970. Each of the ground base 950, the retention ring 970, and the retention ring receiver 990 may have at least two pin holes on opposing sides such that the retention pin is inserted through the ground base 950, the retention ring 970, and the retention ring receiver 990 to secure the traffic control marker 910.

Figure 10:
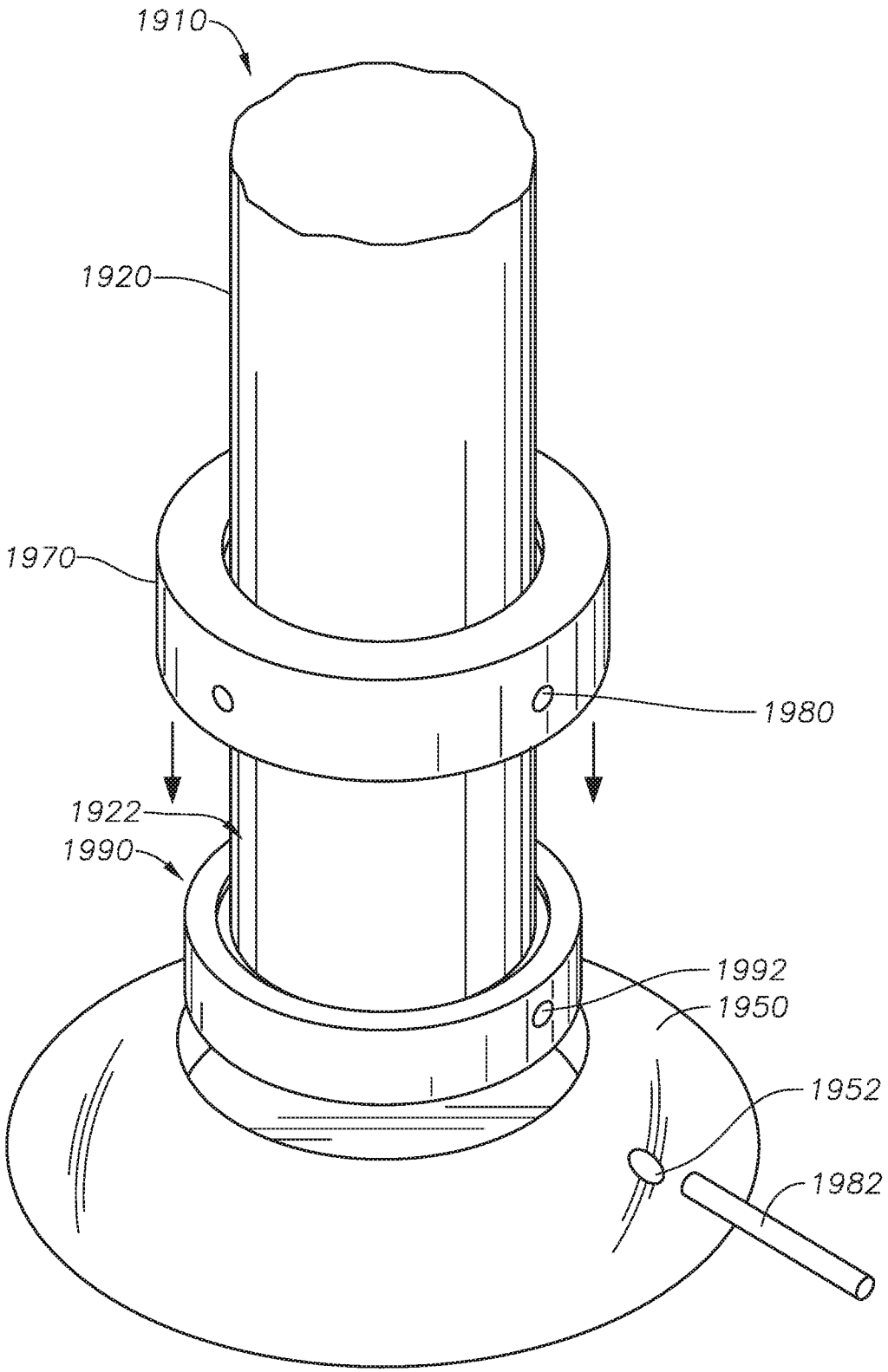
FIG. 10 shows an enlarged perspective view of the lower portion of an embodiment of a traffic control marker configured with a base and retention ring system.

FIG. 10 shows an enlarged perspective view of the lower portion 1922 of an embodiment of a traffic control marker 1910 configured with a ground base and retention ring system. This view illustrates the alternative embodiment mentioned in reference to FIGS. 9A and 9B, where the lower portion 1922 of the traffic control marker 1910 can be a separate piece that connects to the main traffic control marker body 1920. In this embodiment, retention ring 1970 is configured and mates with retention ring receiver 1990. In this embodiment, the materials and/or makeup of the main traffic control marker body 1920 can differ from the lower portion of the traffic control marker 1922 since they are separate pieces. The traffic control marker main body 1920 or "post" may be adhered to the lower portion 1922 of the traffic control marker 1910 or may be mechanically connected to the lower portion 1922 of the traffic control marker 1910. The retention ring pin holes 1980 can be lined up with the body retention pin holes 1992 and the base retention pin holes 1952 and a retention pin 1982 can be inserted, thereby securing the traffic control marker 1910 to the ground base 1950.

Other marker body configurations may be substituted into the various embodiments described herein as would be understood by one of ordinary skill in the art.

Embodiments of the disclosure described, therefore, are well adapted to carry out the objects and attain the ends and advantages mentioned, as well as others that are inherent. While example embodiments of the disclosure have been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A traffic control marker, comprising:

a flexible tube having a bottom end configured to be secured to the ground and comprising a longitudinal channel, wherein the flexible tube has an outer surface and an inner surface, and wherein the longitudinal channel is formed by a first channel edge and a second channel edge and is configured to be facing towards oncoming traffic, each of the first channel edge and the second channel edge curved inward towards the longitudinal channel when the traffic control marker is in a non-impacted position; and a reflective element positioned directly on an inner surface of the longitudinal channel corresponding to a portion of the outer surface of the flexible tube located within the longitudinal channel, wherein the first channel edge, the second channel edge, and the inner surface of the longitudinal channel are connected to form a single continuous portion of the flexible tube, and wherein the first channel edge and the second channel edge are configured to close inward towards the inner surface of the longitudinal channel during a vehicle impact event so as to protect at least a portion of the reflective element.

2. The traffic control marker of claim 1, wherein the flexible tube comprises plastic material having a vibrant color.

3. The traffic control marker of claim 1, wherein the reflective element includes an illumination source.

4. The traffic control marker of claim 1, further comprising:

a ground base fixed to the ground wherein the bottom end of the flexible tube is coupled to the ground base.

5. The traffic control marker of claim 4, further comprising:

a retention ring; and a retention ring receiver, wherein the retention ring receiver is coupled to the flexible tube and includes a retention shoulder, and wherein the retention ring is positioned in a recess in the ground base, is coupled to the retention ring receiver, and includes a retention ring shoulder configured to mate with the retention shoulder of the retention ring receiver.

6. The traffic control marker of claim 5, further comprising:

a retention pin, wherein each of the ground base, the retention ring, and the retention ring receiver has two pin holes on opposing sides such that the retention pin is inserted through the ground base, the retention ring, and the retention ring receiver configured to secure the flexible tube.

* * * * *